US008911278B2

(12) United States Patent
Hoyo

(10) Patent No.: US 8,911,278 B2
(45) Date of Patent: Dec. 16, 2014

(54) SLING AND PUPPET TOY

(75) Inventor: Marcelino Hoyo, Windermere, FL (US)

(73) Assignee: Clonies, Inc., Windermere, FL (US)

( * ) Notice: Subject to any disclaimer, the term of this patent is extended or adjusted under 35 U.S.C. 154(b) by 122 days.

(21) Appl. No.: 13/287,655

(22) Filed: Nov. 2, 2011

(65) Prior Publication Data

US 2012/0108140 A1 May 3, 2012

Related U.S. Application Data

(60) Provisional application No. 61/409,201, filed on Nov. 2, 2010.

(51) Int. Cl.
*A63H 3/14* (2006.01)
*A63J 19/00* (2006.01)

(52) U.S. Cl.
CPC ..... *A63J 19/006* (2013.01)
USPC ..... 446/327; 446/329; 446/372

(58) Field of Classification Search
USPC ..... 446/26–28, 327–329, 340, 366–368, 446/390, 391, 395
See application file for complete search history.

(56) References Cited

U.S. PATENT DOCUMENTS

| | | | | | |
|---|---|---|---|---|---|
| 3,841,543 | A | * | 10/1974 | Bolton | 224/158 |
| 4,280,292 | A | * | 7/1981 | Hills | 40/538 |
| 4,757,925 | A | * | 7/1988 | Knittel | 224/158 |
| 4,978,921 | A | * | 12/1990 | Indig et al. | 324/446 |
| 5,304,087 | A | * | 4/1994 | Terzian et al. | 446/340 |
| 5,368,518 | A | * | 11/1994 | Hitchcock | 446/329 |
| 6,065,655 | A | * | 5/2000 | Parewick | 224/158 |

* cited by examiner

*Primary Examiner* — Nini Legesse
(74) *Attorney, Agent, or Firm* — Timothy H. Van Dyke; Beusse, Wolter, Sanks & Maire, P.A.

(57) ABSTRACT

Disclosed herein is a toy puppet that is supportable on a manipulator's torso. In particular, a torso-supporting means typically takes the form of a sling in which the puppet figure is supported. The sling can be tied about the user or have two ends which are attachable. Typically, the ends are attached via velcro. Thus, the torso-supportable puppet has a slit into which the user can insert their hands to manipulate the puppet. The torso supportable means also comprises a slit into which the user can insert their hand. When the puppet is manipulated, the inserted hand is hidden by the puppet which gives the operation of the puppet a life-like feel.

6 Claims, 3 Drawing Sheets

SLING AND PUPPET TOY

CROSS-REFERENCE TO RELATED APPLICATIONS

This application is related to U.S. Provisional Patent Application No. 61/409,201, filed Nov. 2, 2010, to which priority is claimed under 35 USC 119.

DESCRIPTION

Figure 6:
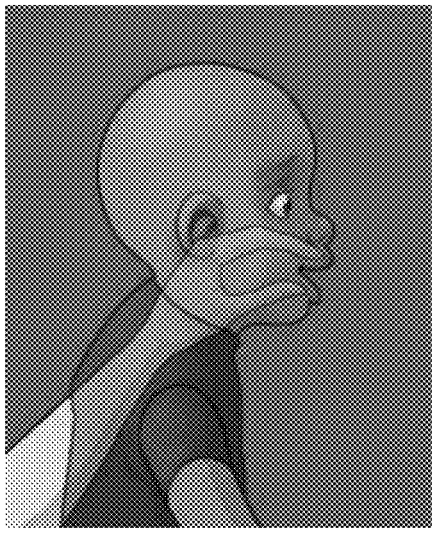
FIG. 6 shows a side see-through view of a user's hand in the puppet embodiment.

Small- and large-scale manipulatable puppets resembling an animal, person or like figure are well-known for their play value and entertainment appeal to all audiences, especially children. Such puppets include the full-bodied articulated puppets having jointed string-supported limbs which are separately manipulatable from above the puppet, as well as miniature finger puppets and hand puppets. The finger puppets are manipulated solely by the manipulator's fingers, whereas the hand puppets generally require the manipulator's entire hand. The manipulator may use all the fingers of his hand to move the puppet's mouth or, in some cases, the manipulator inserts at least one finger into the puppet head, and inserts his other fingers into the puppet's respective limbs to provide full-bodied puppet movement.

Although generally satisfactory for their intended play and entertainment purposes, as well as for educational and physical coordination purposes, the finger- and hand-puppets of the prior art are miniature figures in the sense that they must generally conform to the size of the manipulator's fingers and/or hand. In order to provide a more life-like puppet, it is desirable to increase the overall dimensions of the finger- and hand-puppets to a size which is larger than the average human hand. However, only the puppet head of such larger-sized puppets is directly supported by the manipulator's hand. The puppet arms and legs are typically left unsupported and unmanipulatable. Such dangling limbs impart a very unappealing and undesirable limp appearance for the puppet. As a result, the limp puppet not only fails to create the impression of a realistic-looking large-scale puppet figure, but also fails to properly display the puppet in, for example, a commercial setting.

In order to increase the play, entertainment, educational and coordination value of a large-sized puppet, the inventor has realized that it is very desirable for the puppet to assume an embracing-, cuddling- and hugging-type posture with the person. It is believed that no manipulative puppet exists in the prior art which is supportable on the manipulator's person, or which is positioned in a hugging-type posture during use.

In keeping with these advantages and others which will become apparent hereinafter, one feature of the invention resides, briefly stated, in a toy puppet which is supportable not only on a human torso, but also on a display support. In a preferred embodiment, the toy puppet has a figure which resembles a baby-like figure. The puppet has a hollow puppet head, a hollow puppet body mounted on the puppet head.

As noted above, the toy puppet is supportable on a manipulator's torso. In accordance with this invention, torso-supporting means are provided on the puppet figure for supporting the same on the manipulator's torso. The torso-supporting means typically takes the form of a sling in which the puppet figure is supported. The sling can be tied about the user or have two ends which are attachable. Typically, the ends are attached via Velcro or via a strap, or some combination of both.

The torso-supportable puppet has a slit into which the user can insert their hands to manipulate the puppet. The torso supportable means also comprises a slit into which the user can insert their hand. When the puppet is manipulated, the inserted hand is hidden by the puppet which gives the operation of the puppet a life-like feel.

The aforesaid puppet posture greatly increases the play value and entertainment appeal for children, because it appears that the puppet is resting in the sling in a loving manner. Also, when the hand is inserted into the interior cavity of the puppet, the inserted hand is hidden and the user looks to have a normal posture, which results in a more life-like appearance for the puppet.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

Figure 2:
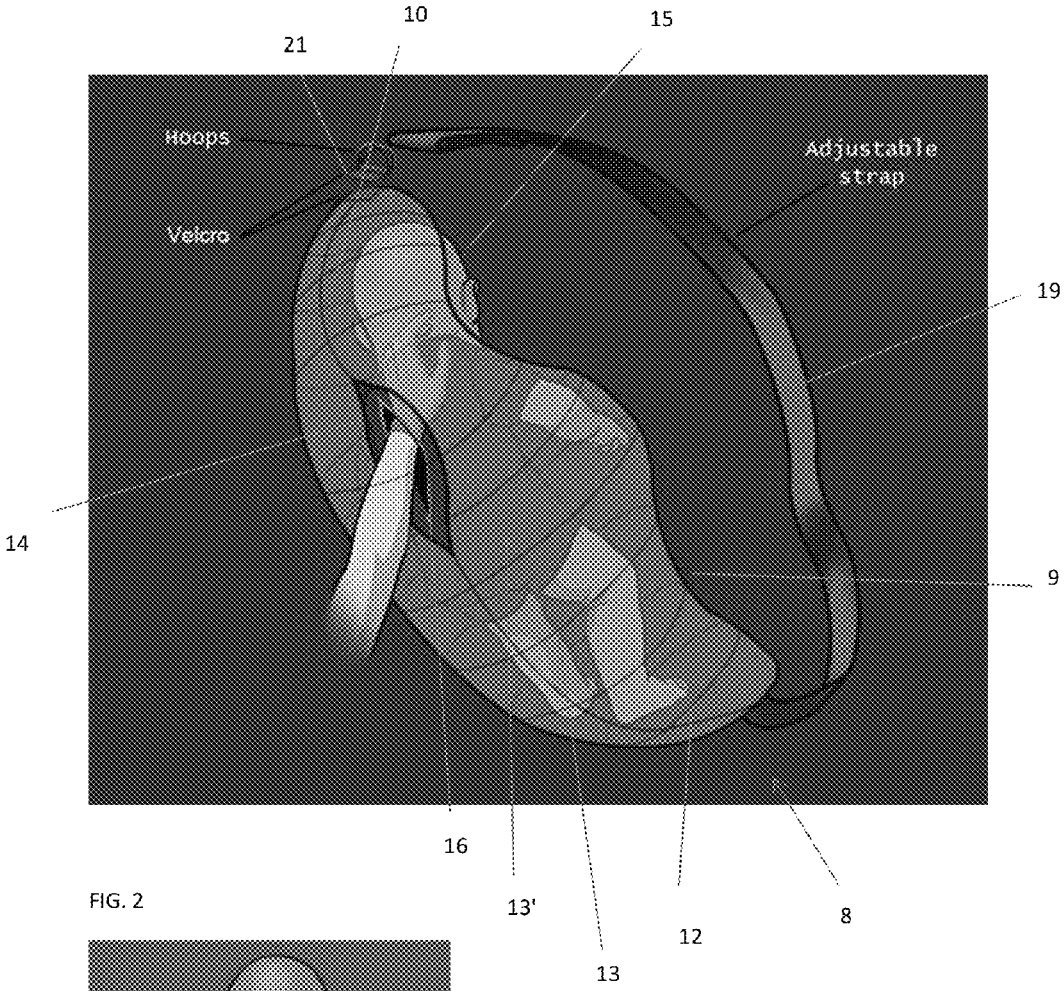
FIG. 2 shows a rear view of a puppet/sling combination embodiment.

Given the fact the puppet is supported in a sling, the puppet will typically take the form of a baby or infant. The puppet/sling combination portrays a truly lifelike baby sling that hides operation of the puppet by the user's hand. In a specific embodiment, as shown in FIG. 2, the invention pertains to a puppet sling combination 8 where the sling 9 has a first end 10 and a second end 12 connected by a sling body 13 interposed between said first and second ends 10, 12. The sling, for this embodiment, is in the form of a pliable planar sheet. Defined at a strategic location in the sling body 13 is an opening, such as a slit 14, through which the user inserts their hand. During operation of the puppet 15, the sling is wrapped around the shoulder of the user and connected at the first and second ends. The sling body acts as a cradle socket 13' into which a puppet is disposed. The puppet typically at least includes a head and a torso portion. The puppet includes an opening 16 that is accessible via the slit 14 in the sling body 13. While the sling 9 is wrapped about the user and the puppet is situated into socket 13' formed by the sling body, the user inserts their hand through the sling body slit 14 and then into the puppet via opening 16. The hand can then be directed to the operational area of the puppet such as to the head. A hook and loop fabric attachments may be included to secure the first end 10 to the second end 12.

Shown in the embodiment of FIG. 2 is an adjustable strap 19 that is engageable to the sling body 13. As shown, the strap is connectable by a hook and loop fabric assembly 21. The assembly has a first piece of hook and loop fabric on the end 10 and a second piece matable with the first piece. The second piece includes hoops through which the adjustable strap 19 can be fastened. The assembly has the additional advantage as serving as a safety feature should the strap 19 be caught on something.

Figure 5:
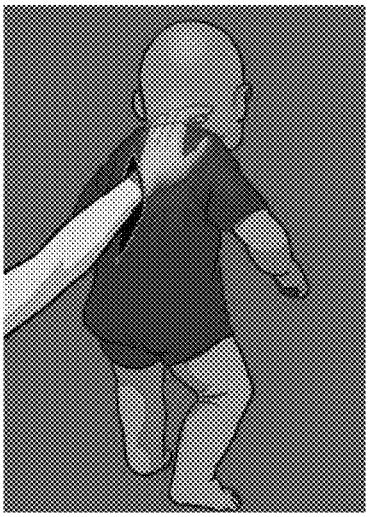
FIG. 5 shows a picture of a rear see-through view of a user's hand in the puppet embodiment without the sling.

FIG. 5 shows a rear transparent view of a puppet embodiment that shows a user's hand positioned within the puppet. FIG. 5 is shown without the unique sling design. FIG. 6 shows a side transparent view of the head of the puppet to show the user's hand positioned in the head of the puppet.

Figure 1:
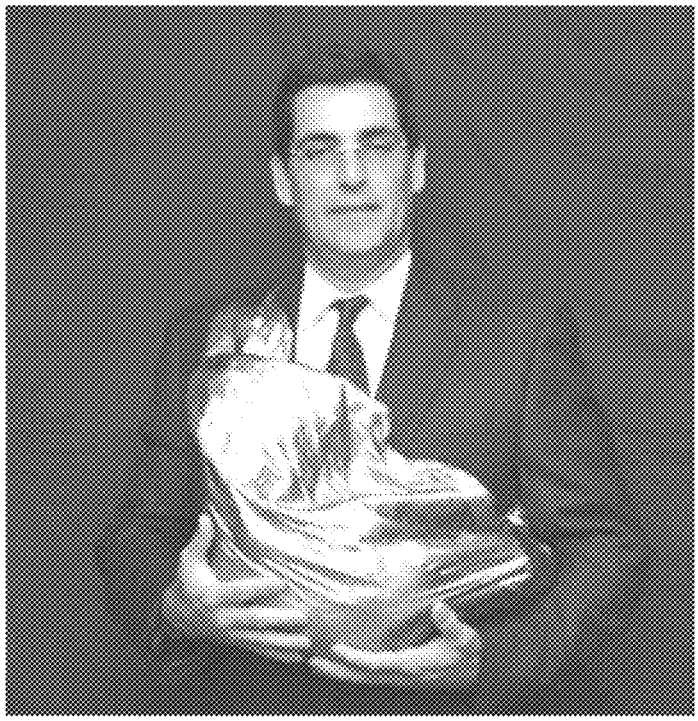
FIG. 1 shows a picture of a puppet embodiment about the torso of a user.
Figure 3:
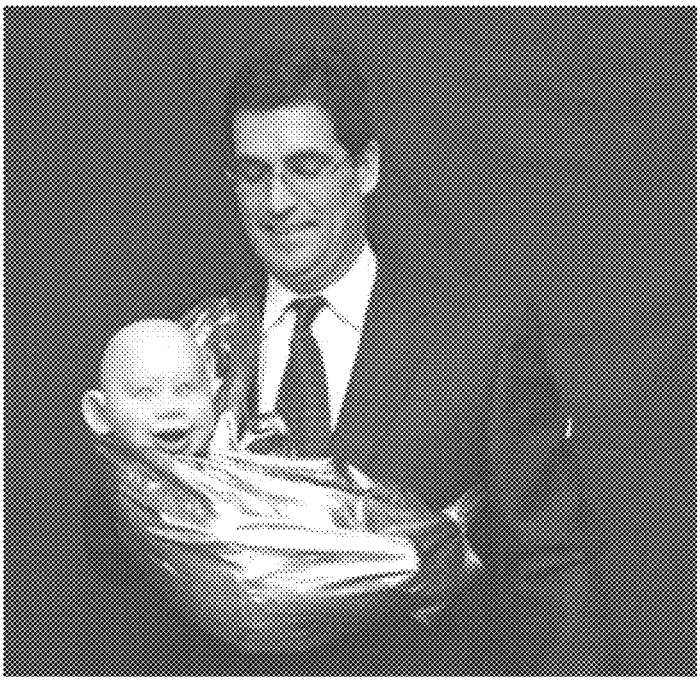
FIG. 3 shows another picture of a puppet/sling embodiment about the torso of a user with the user's hand positioned through the sling and in the puppet.
Figure 4:
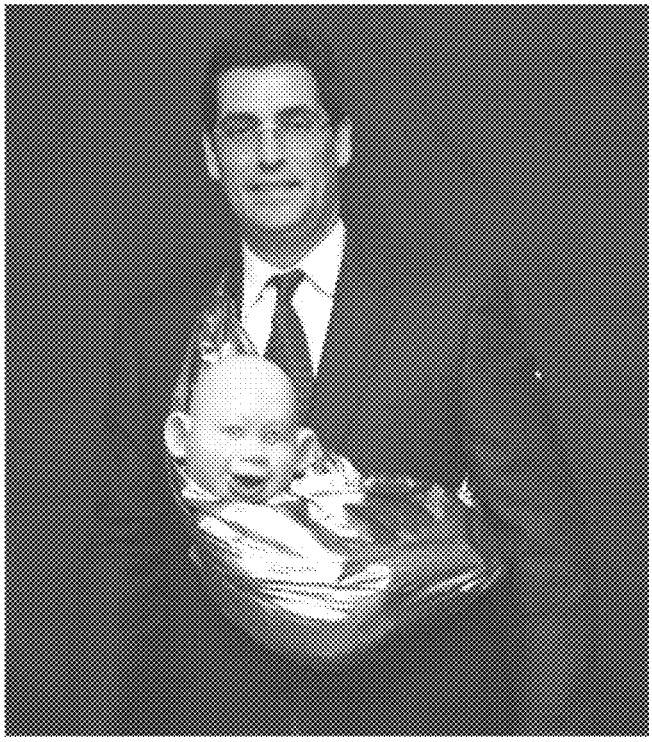
FIG. 4 shows a picture of a puppet/sling embodiment with the user's hand out of the embodiment.

FIG. 1 shows a photograph of an embodiment in use. The sling is wrapped around the users shoulder and the puppet fits inside. The user puts his hand through the slit in the sling and the puppet. See FIG. 3. Shown in FIG. 4 is the baby resting in the sling without the users hand inserted therethrough.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

Thus, the breadth and scope of the subject matter provided in this Disclosure should not be limited by any of the above explicitly described embodiments. Rather, the scope of this Disclosure should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The teachings of any patents, patent applications, technical or scientific articles or other references are incorporated herein in their entirety to the extent not inconsistent with the teachings herein.

What is claimed is:

1. A puppet assembly that is supported about a torso of an operator, the assembly comprising a a sling component comprising a pliable, planar sheet of material, said sling component comprising a first end, a second end and a body portion, and a sling slit defined in the body portion, wherein said body portion forms a cradle socket; and a puppet component disposed within said cradle socket of said sling component, said puppet comprising a head portion and a body portion, wherein said puppet defines a cavity for placement of the operator's hand for manipulating said puppet and a puppet slit defined thereon for insertion of the operator's hand into the cavity; wherein during operation of the puppet assembly, the sling component is supported over the shoulder of the operator and said sling slit and puppet slit are aligned whereby the cavity is accessible via the sling slit and the puppet slit.

2. The puppet assembly of claim 1, wherein said first end and second end are associated together.

3. The puppet assembly of claim 2, wherein said first end and second end are tied together.

4. The puppet assembly of claim 2, wherein said first end and second end are removably attached by a hook and loop fabric associated on respective ends.

5. The puppet assembly of claim 1, wherein said puppet is in the form of an infant.

6. The puppet assembly of claim 1, wherein said first and second ends are tapered respective to said body portion.

* * * * *